US006427473B1

(12) United States Patent
Kurokawa et al.

(10) Patent No.: US 6,427,473 B1
(45) Date of Patent: Aug. 6, 2002

(54) COLD INSULATED CABINET

(75) Inventors: Sadanao Kurokawa; Akitoshi Ueno; Yuji Fujimoto; Makoto Ikemiya, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/868,853

(22) PCT Filed: Dec. 20, 1999

(86) PCT No.: PCT/JP99/07125

§ 371 (c)(1),
(2), (4) Date: Jun. 21, 2001

(87) PCT Pub. No.: WO00/37866

PCT Pub. Date: Jun. 29, 2000

(30) Foreign Application Priority Data

Dec. 21, 1998 (JP) ..... 10-362690
Jun. 4, 1999 (JP) ..... 11-157628

(51) Int. Cl.[7] ..... F25D 11/00
(52) U.S. Cl. ..... 62/430; 62/434; 62/440
(58) Field of Search ..... 62/430, 434, 371, 62/457.1, 457.9, 440, 529, 237, 411

(56) References Cited

U.S. PATENT DOCUMENTS 3,632,012 A * 1/1972 Kitson ..... 220/9 F
4,637,222 A * 1/1987 Fujiwara et al. ..... 62/244
4,928,501 A * 5/1990 Negishi ..... 62/406
5,029,450 A * 7/1991 Takano et al. ..... 62/239
6,128,914 A * 10/2000 Tamaoki et al. ..... 62/440

FOREIGN PATENT DOCUMENTS

| | | |
|---|---|---|
| JP | 176687/1980 | 6/1982 |
| JP | 153438/1981 | 4/1983 |
| JP | 63-201467 | 8/1988 |
| JP | 2-13772 | 1/1990 |
| JP | 2-176385 | 7/1990 |
| JP | 3-247971 | 11/1991 |

* cited by examiner

*Primary Examiner*—Denise L. Esquivel
*Assistant Examiner*—Melvin Jones
(74) *Attorney, Agent, or Firm*—Nixon Peabody LLP; Donald R. Studebaker

(57) ABSTRACT

A cold-insulation container is disclosed which includes a cold-insulation container main body (1) which is a heat-insulation structure and a door (2) for opening and closing an opening portion (4) of the cold-insulation container main body (1). Provided in the cold-insulation container main body (1) are a refrigerating apparatus (19) and a cold-storage device (20) which is cooled by the refrigerating apparatus (19) and stores cold. An external wall of the cold-insulation container main body (1) and the door 2 are formed from a synthetic resin material.

22 Claims, 8 Drawing Sheets

COLD INSULATED CABINET

TECHNICAL FIELD

The present invention relates to a cold-insulation container that is loaded on a vehicle such as a truck and transported. The present invention relates more particularly to an external-wall structure for such a cold-insulation container.

BACKGROUND ART

A typical type of cold-insulation container which is loaded on a vehicle such as a truck and transported includes a cold-keeping means comprising a refrigerating apparatus and a cold-storage device which is cooled by the refrigerating apparatus and stores cold. The refrigerating apparatus is operated only at the storage warehouse of a delivery terminal. During transportation, the refrigerating apparatus is not operated and the cold-keeping of products to be kept cold which are contained in the cold-insulation container is performed using cold which has been stored in the cold-storage device.

In such a type of cold-insulation container, its cold-insulation container main body and door employ a heat-insulation structure of steel sheet.

PROBLEMS TO BE SOLVED

In order to cut transportation costs, it is necessary to reduce the weight of a cold-insulation container of the above type. However, as stated above, such a cold-insulation container employs a heat-insulation structure of steel sheets which is heavy. This gives rise to the inconvenience that the weight of a cold-insulation container becomes approximately the same as that of products to be cooled which are stored in the cold-insulation container. For example, the weight of a cold-insulation container with a load capacity of 300 kg is 300 kg.

Bearing in mind the above-described problem, the present invention was made. Accordingly, an object of the present invention is to improve transportation efficiency by forming an external wall of a cold-insulation container main body and a door with a synthetic resin for weight reduction.

DISCLOSURE OF THE INVENTION

A first invention is disclosed which comprises a cold-insulation container main body 1 which is a heat-insulation structure, a door 2 for opening and closing an opening portion 4 of the cold-insulation container main body 1, and a cold-keeping means 3 which is disposed in the cold-insulation container main body 1. And, the cold-keeping means 3 includes a refrigerating apparatus 19 which is positioned in the cold-insulation container main body 1 and a cold-storage device 20 which is cooled by the refrigerating apparatus 19 and stores cold. In addition, an external wall of the cold-insulation container main body 1 and the door 2 are formed from a synthetic resin material.

In the first invention, the cold-insulation container main body 1 and the door 2 are reduced considerably in their weight, thereby resulting in the increase in loadable weight. Accordingly, there is achieved a considerable improvement in transportation efficiency.

A second invention according to the first invention is disclosed in which outwardly projecting portions 25 and 26 for reinforcement are formed on the external wall of the cold-insulation container main body 1 and on the door 2, respectively.

In the second invention, the section modulus of the cold-insulation container main body 1 and the door 2 increases, whereby the external wall structural strength of the cold-insulation container is improved. Further, at the time of handling a cold-insulation container, even when it collides with another cold-insulation container, such collision contact will occur between the reinforcement projecting portions 25 and 26 of one of the cold-insulation containers and the reinforcement projecting portions 25 and 26 of the other cold-insulation container. Consequently, the structural strength against collision load is enhanced.

A third invention is disclosed which comprises a cold-insulation container main body 1 which is a heat-insulation structure, a door 2 for opening and closing an opening portion 4 of the cold-insulation container main body 1, and a cold-keeping means 3 which is disposed in the cold-insulation container main body 1. And, an external wall of the cold-insulation container main body 1 and the door 2 are formed from a synthetic resin material. In addition, outwardly projecting portions 25 and 26 for reinforcement are formed on the external wall of the cold-insulation container main body 1 and on the door 2, respectively.

In the third invention, the cold-insulation container main body 1 and the door 2 are reduced considerably in their weight, thereby resulting in the increase in loadable weight. Accordingly, there is achieved a considerable improvement in transportation efficiency. Further, at the time of handling a cold-insulation container, even when it collides with another cold-insulation container, such collision contact will occur between the reinforcement projecting portions 25 and 26 of one of the cold-insulation containers and the reinforcement projecting portions 25 and 26 of the other cold-insulation container. Consequently, the structural strength against collision load is enhanced.

A fourth invention according to the second or third invention is disclosed in which the external wall of the cold-insulation container main body 1 and the door 2 are constructed by filling a heat-insulation material 13 between a synthetic-resin internal plate 11 and a synthetic-resin external plate 12, and by filling a heat-insulation material 16 between a synthetic-resin internal plate 14 and a synthetic-resin external plate 15. Further, the reinforcement projecting portions 25 and 26 are formed by causing the external plates 12 and 15 to project outwardly.

In the fourth invention, the reinforcement projecting portions 12 and 15 are formed by only causing the external plates 12 and 15 to project outwardly. Furthermore, the thickness of the heat-insulation materials 13 and 16 in the reinforcement projecting portions 25 and 26 increases, thereby providing an improvement in heat-insulation efficiency.

A seventh invention according to the second or third invention is disclosed in which the external wall of the cold-insulation container main body 1 and the door 2 are constructed by filling a heat-insulation material 13 between a synthetic-resin internal plate 11 and a synthetic-resin external plate 12, and by filling a heat-insulation material 16 between a synthetic-resin internal plate 14 and a synthetic-resin external plate 15. Further, the reinforcement projecting portions 25 and 26 are formed outwardly from and integrally with the external plates 12 and 15, having therein space portions 27 and 28.

In the seventh invention, it is sufficient that the reinforcement projecting portions 25 and 26 are formed outwardly from and integrally with the external plates 12 and 15. Further, by virtue of the provision of the space portions 27 and 28 formed in the reinforcement projection portions 25 and 26, the heat-insulation efficiency at these portions is improved.

A tenth invention according to the second or third invention is disclosed in which the external wall of the cold-insulation container main body 1 and the door 2 are constructed by filling a heat-insulation material 13 between a synthetic-resin internal plate 11 and a synthetic-resin external plate 12, and by filling a heat-insulation material 16 between a synthetic-resin internal plate 14 and a synthetic-resin external plate 15. Further, the reinforcement projecting portions 25 and 26 are formed by increasing the thickness of the external plates 12 and 15.

In the tenth invention, it is possible to form the reinforcement projecting portions 25 and 26 by only increasing the thickness of the external plates 12 and 15.

Further, such increase in the thickness of the external plates 12 and 15 provides an improvement in the strength of the reinforcement projecting portions 25 and 26.

A fifth, an eighth, and an eleventh invention according to the fourth, the seventh, and the tenth invention, respectively, are disclosed in each of which ribs 29 and 30 for connecting the internal plates 11 and 14 to the external plates 12 and 15 are formed at base portions of the reinforcement projecting portions 25 and 26.

In each of these inventions, the internal plates 11 and 14 and the external plates 12 and 15 are reinforced by the ribs 29 and 30, thereby improving the strength to a further extent.

A sixth, a ninth, and a twelfth invention according to the fourth, the seventh, and the tenth invention, respectively, are disclosed in each of which outwardly-facing projecting portions 31 and 32 corresponding to the reinforcement projecting portions 25 and 26 are formed at portions of the internal plates 11 and 14 corresponding to the reinforcement projecting portions 25 and 26.

In each of these inventions, the section modulus of the internal plates 11 and 14 also increases. Consequently, the strength of the internal plates 11 and 14 is improved and the capacity of the cold-insulation container main body 1 also increases.

A thirteenth invention according to the second or third invention is disclosed in which elastic members 33 and 34 are attached to outer surfaces of the reinforcement projecting portions 25 and 26.

In the thirteenth invention, at the time of handling a cold-insulation container, even when it collides with another cold-insulation container, the elastic members 33 and 34 absorb a collision load. Consequently, the cold-insulation container main body 1 and the door 2 are made further lighter in weight.

A fifteenth invention according to the second or third invention is disclosed in which elastic members 33 and 34 are attached to the external wall of the cold-insulation container main body 1 and the door 2 so that the elastic members 33 and 34 project outwardly beyond the reinforcement projecting portions 25 and 26.

In the fifteenth invention, at the time of handling a cold-insulation container and even when it collides with another cold-insulation container, the elastic members 33 and 34 absorb a collision load. Consequently, the cold-insulation container main body 1 and the door 2 are made further lighter in weight.

A fourteenth and a sixteenth invention according to the thirteenth and the fifteenth invention, respectively, are disclosed in each of which hollow portions 35 and 36 are formed in the elastic members 33 and 34.

In each of these inventions, the absorption efficiency of collision load is improved by the elastic members 33 and 34.

A seventeenth invention according to the second or third invention is disclosed in which a recessed portion 42 is formed at a corner portion C of portions sandwiching therebetween the reinforcement projecting portion 25 in the cold-insulation container main body 1, the recessed portion 42 extending astride both lateral walls from the corner portion C.

In the seventeenth invention, when handling a cold-insulation container, it is possible to prevent fingers of a handler from being caught between the cold-insulation container and its neighboring cold-insulation container by pushing it with the fingers placed thereon. Consequently, this not only improves safety during cold-insulation container handling but also insures heat-insulation efficiency because there is no need to make the entire portion other than the reinforcement projecting portion 25 in the external wall of the cold-insulation container main body 1 thin.

An eighteenth invention according to the seventeenth invention is disclosed in which a handle 41 that is held when handling a cold-insulation container is positioned in the reinforcement projecting portion 25 sandwiched between the recessed portions 42.

In the eighteenth invention, although there is a possibility of handling a cold-insulation container with a hand of the handler placed on the corner portion C near the handle 41, fingers of the handler are, at that time, placed in the recessed portions 42. Consequently, this prevents the fingers from being caught between the cold-insulation container and its neighboring cold-insulation container.

A nineteenth invention according to the second or third invention is disclosed in which the external wall of the cold-insulation container main body 1 and the door 2 are constructed by filling a heat-insulation material 13 between a synthetic-resin internal plate 11 and a synthetic-resin external plate 12, and by filling a heat-insulation material 16 between a synthetic-resin internal plate 14 and a synthetic-resin external plate 15. Further, the thickness of the external plates 12 and 15 of the cold-insulation container main body 1 and the door 2 is greater than that of the internal plates 11 and 14 of the cold-insulation container main body 1 and the door 2.

In the nineteenth invention, the ensuring of weight reduction and the ensuring of strength are compatible. That is, the external plates 12 and 15 to which great force such as collision load acts on are made thick to secure strength and, on the other hand, the internal plates 11 and 14 are made thin to achieve the reduction in weight.

A twentieth invention according to the fourth invention is disclosed in which the thickness of the reinforcement projecting portion 25 of the external plate 12 in the external wall of the cold-insulation container main body 1 is greater than that of portions of the external plate 12 other than the reinforcement projecting portion 25.

In the twentieth invention, it is possible to provide a degree of strength strong enough to withstand collision load etc.

A twenty-first invention according to the fourth invention, the reinforcement projecting portion 25 of the external plate 12 in the external wall of the cold-insulation container main body 1 is projected 5 mm or more.

In the twenty-first invention, it is possible to provide a sufficient degree of strength against collision or the like.

A twenty-second invention according to the second or third invention is disclosed in which the occupation ratio of the reinforcement projecting portions 25 and 26 of the external wall of the cold-insulation container main body 1 and the door 2 is equal to or greater than that of portions other than the reinforcement projecting portion 25 of the external wall and the door 2.

In the twenty-second invention, the occupation ratio of the reinforcement projecting portions 25 and 26 is great, thereby ensuring that a specified degree of strength is obtained positively.

Finally, a twenty-third invention according to the thirteenth invention is disclosed in which attachment grooves 25*a* and 26*a* for the elastic members 33 and 34 are formed in the reinforcement projecting portions 25 and 26 in the external wall of the cold-insulation container main body 1 and the door 2. Further, the elastic members 33 and 34 are attached into the attachment grooves 25*a* and 26*a*.

In the twenty-third invention, the attachment grooves 25*a* and 26*a* are formed in the external plates 12 and 15.

As a result of such arrangement, the section modulus of the external plates 12 and 15 increases, thereby improving the degree of strength to a further extent. Moreover, the positioning of the elastic members 33 and 34 is carried out accurately.

EFFECTS OF THE INVENTION

In accordance with the first invention, the external wall of the cold-insulation container main body 1 and the door 2 are formed from a synthetic resin material, thereby making it possible to considerably reduce the weight of the cold-insulation container main body 1 and the door 2. This results in the increase in loadable weight, thereby providing a considerable improvement in transportation efficiency.

In accordance with the second invention, the reinforcement projecting portions 25 and 26 which project outwardly are formed on the external wall of the cold-insulation container main body 1 and on the door 2, respectively, thereby making it possible to increase the section modulus of the cold-insulation container main body and the door 2. As a result, it is possible to improve the external wall structural strength of the cold-insulation container.

Further, at the time of handling a cold-insulation container, even when it collides with another cold-insulation container, such collision contact will occur between the reinforcement projecting portions 25 and 26 of one of the cold-insulation containers and the reinforcement projecting portions 25 and 26 of the other cold-insulation container. Consequently, the strength against collision load is enhanced.

In accordance with the third invention, the external wall of the cold-insulation container main body 1 and the door 2 are formed of a synthetic resin material and, in addition, the outwardly projecting, reinforcement projecting portions 25 and 26 are formed on the external wall of the cold-insulation container main body 1 and on the door 2, respectively, so that the cold-insulation container main body 1 and the door 2 are reduced considerably in their weight. This results in the increase in loadable weight, thereby providing a considerable improvement in transportation efficiency.

Further, at the time of handling a cold-insulation container, even when it collides with another cold-insulation container, such collision contact will occur between the reinforcement projecting portions 25 and 26 of one of the cold-insulation containers and the reinforcement projecting portions 25 and 26 of the other cold-insulation container. Consequently, the strength against collision load is enhanced.

In accordance with the fourth invention, the external wall of the cold-insulation container main body 1 and the door 2 are constructed by filling the heat-insulation material 13 between the synthetic-resin internal plate 11 and the synthetic-resin external plate 12, and by filling the heat-insulation material 16 between the synthetic-resin internal plate 14 and the synthetic-resin external plate 15.

In addition, the reinforcement projection portions 25 and 26 are formed by causing the external plates 12 and 15 to project outwardly, whereby the reinforcement projecting portions 12 and 15 can be formed by only causing the external plates 12 and 15 to project outwardly.

And besides, the thickness of the heat-insulation materials 13 and 16 in the reinforcement projecting portions 25 and 26 increases, thereby providing an improvement in heat-insulation efficiency.

In accordance with the seventh invention, the external all of the cold-insulation container main body 1 and the door 2 are constructed by filling the heat-insulation material 13 between the synthetic-resin internal plate 11 and the synthetic-resin external plate 12, and by filling the heat-insulation material 16 between the synthetic-resin internal plate 14 and the synthetic-resin external plate 15. In addition, the reinforcement projecting portions 25 and 26 are formed outwardly from and integrally with the external plates 12 and 15, having therein the space portions 27 and 28. As a result, it is sufficient that the reinforcement projecting portions 25 and 26 are formed outwardly from and integrally with the external plates 12 and 15.

Further, by virtue of the provision of the space portions 27 and 28 formed in the reinforcement projection portions 25 and 26, the heat-insulation efficiency at these portions can be improved.

In accordance with the tenth invention, the external wall of the cold-insulation container main body 1 and the door 2 are constructed by filling the heat-insulation material 13 between the synthetic-resin internal plate 11 and the synthetic-resin external plate 12, and by filling the heat-insulation material 16 between the synthetic-resin internal plate 14 and the synthetic-resin external plate 15.

In addition, the reinforcement projecting portions 25 and 26 are formed by increasing the thickness of the external plates 12 and 15. It is therefore possible to form the reinforcement projecting portions 25 and 26 by only increasing the thickness of the external plates 12 and 15.

And besides, such increase in the thickness of the external plates 12 and 15 improves the strength of the reinforcement projecting portions 25 and 26.

In accordance with each of the fifth, the eighth, and the eleventh invention, the ribs 29 and 30 for connecting the internal plates 11 and 14 to the external plates 12 and 15 are formed at the base portions of the reinforcement projecting portions 25 and 26. As a result of such arrangement, the internal plates 11 and 14 and the external plates 12 and 15 are reinforced by the ribs 29 and 30, thereby improving the strength to a further extent.

In accordance with each of the sixth, the ninth, and the twelfth invention, the outwardly-facing projecting portions 31 and 32 corresponding to the reinforcement projecting portions 25 and 26 are formed at the portions of the internal plates 11 and 14 corresponding to the reinforcement projecting portions 25 and 26. As a result of such arrangement, the section modulus of the internal plates 11 and 14 can also be increased. Consequently, the strength of the internal plates 11 and 14 can be improved and the capacity of the cold-insulation container main body 1 can also be increased.

In accordance with the thirteenth invention, the elastic members 33 and 34 are attached to the outer surfaces of the reinforcement projecting portions 25 and 26 As a result of such arrangement, at the time of handling a cold-insulation container, even when it collides with another cold-insulation container, the elastic members 33 and 34 absorb a collision load. Consequently, the cold-insulation container main body 1 and the door 2 can be made further lighter in weight.

In accordance with the fifteenth invention, the elastic members 33 and 34 are attached to the external wall of the cold-insulation container main body 1 and the door 2, the elastic members 33 and 34 projecting outwardly beyond the reinforcement projecting portions 25 and 26. As a result of such arrangement, at the time of handling a cold-insulation container, even when it collides with another cold-insulation container, the elastic members 33 and 34 absorb a collision load. Consequently, the cold-insulation container main body 1 and the door 2 can be made further lighter in their weight.

In accordance with each of the fourteenth and the sixteenth invention, the hollow portions 35 and 36 are formed in the elastic members 33 and 34. As a result of such arrangement, the efficiency of absorption of a collision load is improved by the elastic members 33 and 34.

In accordance with the seventeenth invention, the recessed portion 42 is formed at the corner portion C of portions sandwiching therebetween the reinforcement projecting portion 25 in the cold-insulation container main body 1, the recessed portion 42 extending astride both lateral walls from the corner portion C. As a result of such arrangement, when handling a cold-insulation container, it is possible to prevent fingers of the handler from being caught between the cold-insulation container and its neighboring cold-insulation container by pushing it with the fingers placed within the recessed portion 42. Consequently, this improves the safety at cold-insulation container handling time.

Further, it is possible to insure heat-insulation efficiency because there is no need to make the entire portion other than the reinforcement projecting portion 25 in the external wall of the cold-insulation container main body 1 thin.

In accordance with the eighteenth invention, the handle 41 that is held when handling a cold-insulation container is positioned on the reinforcement projecting portion 25 sandwiched between the recessed portions 42, so that, although there is a possibility of handling the cold-insulation container with a hand placed on the corner portion C near the handle 41, fingers of the handler are, at that time, placed in the recessed portions 42. Consequently, this prevents the fingers from being caught between the cold-insulation container and its neighboring cold-insulation container.

In accordance with the nineteenth invention, the thickness of the external plates 12 and 15 of the cold-insulation container main body 1 and the door 2 is made greater than that of the internal plates 11 and 14 of the cold-insulation container main body 1 and the door 2. As a result of such arrangement, ensuring weight reduction and ensuring strength are compatible. That is, the external plates 12 and 15 to which great force such as collision load acts on are made thick to secure strength and, on the other hand, the internal plates 11 and 14 are made thin to achieve weight reduction.

In accordance with the twentieth invention, the thickness of the reinforcement projecting portions 25 and 26 is made greater than other portions of the external plates 12 and 15. As a result of such arrangement, it is possible to provide strength strong enough to withstand collision load et cetera.

In accordance with the twenty-first invention, the reinforcement projecting portions 25 and 26 are projected 5 mm or more. As a result of such arrangement, it is possible to provide a sufficient degree of strength against collision et cetera.

In accordance with the twenty-second invention, in the external plates 12 and 15 of the portions corresponding to the cold-insulation chamber 5, the occupation ratio of the reinforcement projecting portions 25 and 26 is made equal to or greater than that of the other portions thereof. Such arrangement ensures that a specified degree of strength is obtained positively.

Finally, in accordance with the twenty-third invention, the attachment grooves 25*a* and 26*a* for the elastic members 33 and 34 are formed in the external plates 12 and 15. As a result of such arrangement, the section modulus of the external plates 12 and 15 increases, thereby improving the strength to a further extent. And besides, since the elastic members 33 and 34 are attached into the attachment grooves 25*a* and 26*a*, the positioning of the elastic members 33 and 34 can be carried out accurately.

BEST MODES FOR CARRYING OUT THE INVENTION

Hereinafter, embodiments of the present invention will be described in detail with reference to the accompanying drawings.

First Embodiment

Figure 1:
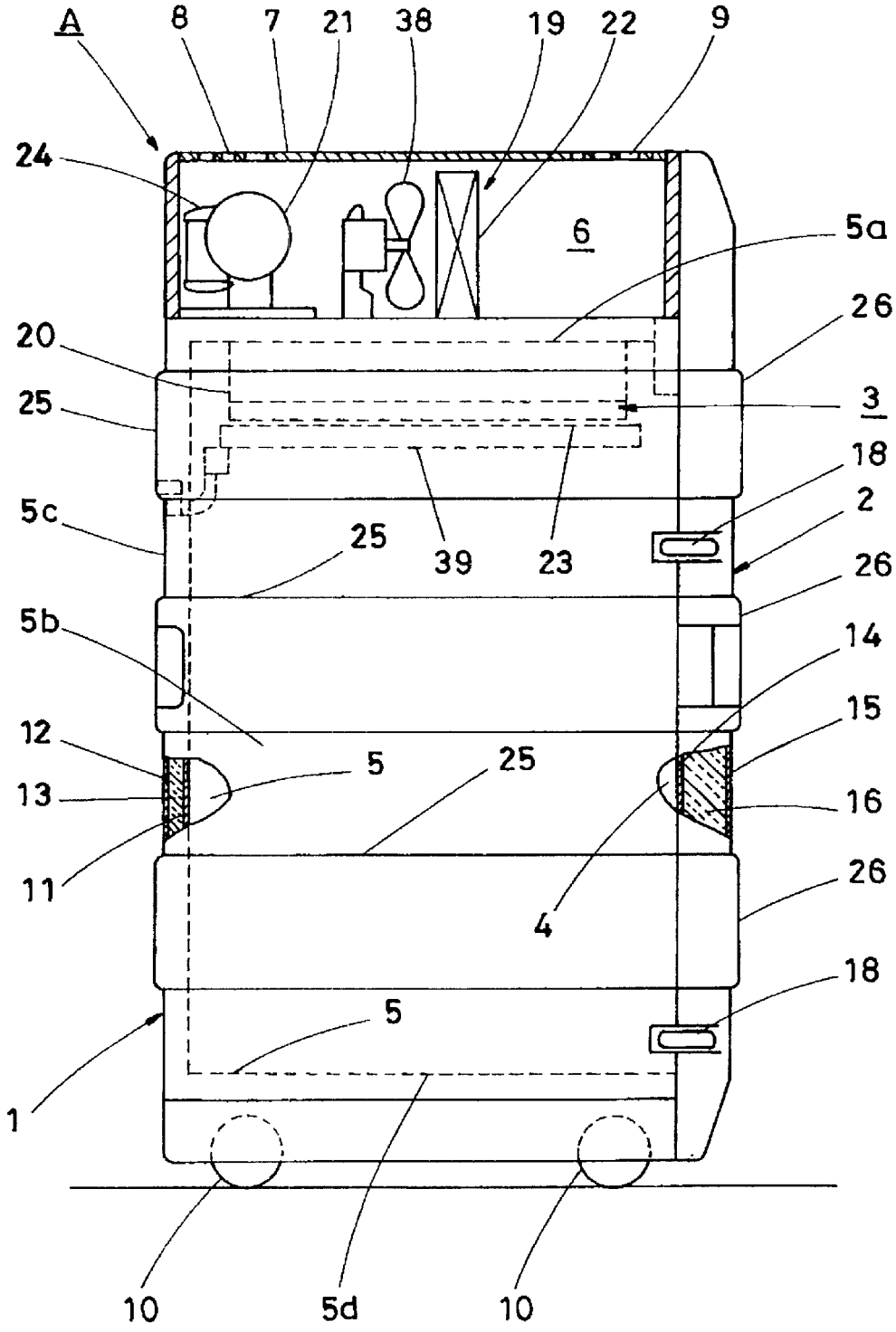
FIG. 1 is a side view of a cold-insulation container according to a first embodiment of the present invention, with a part thereof shown in cross section.
Figure 2:
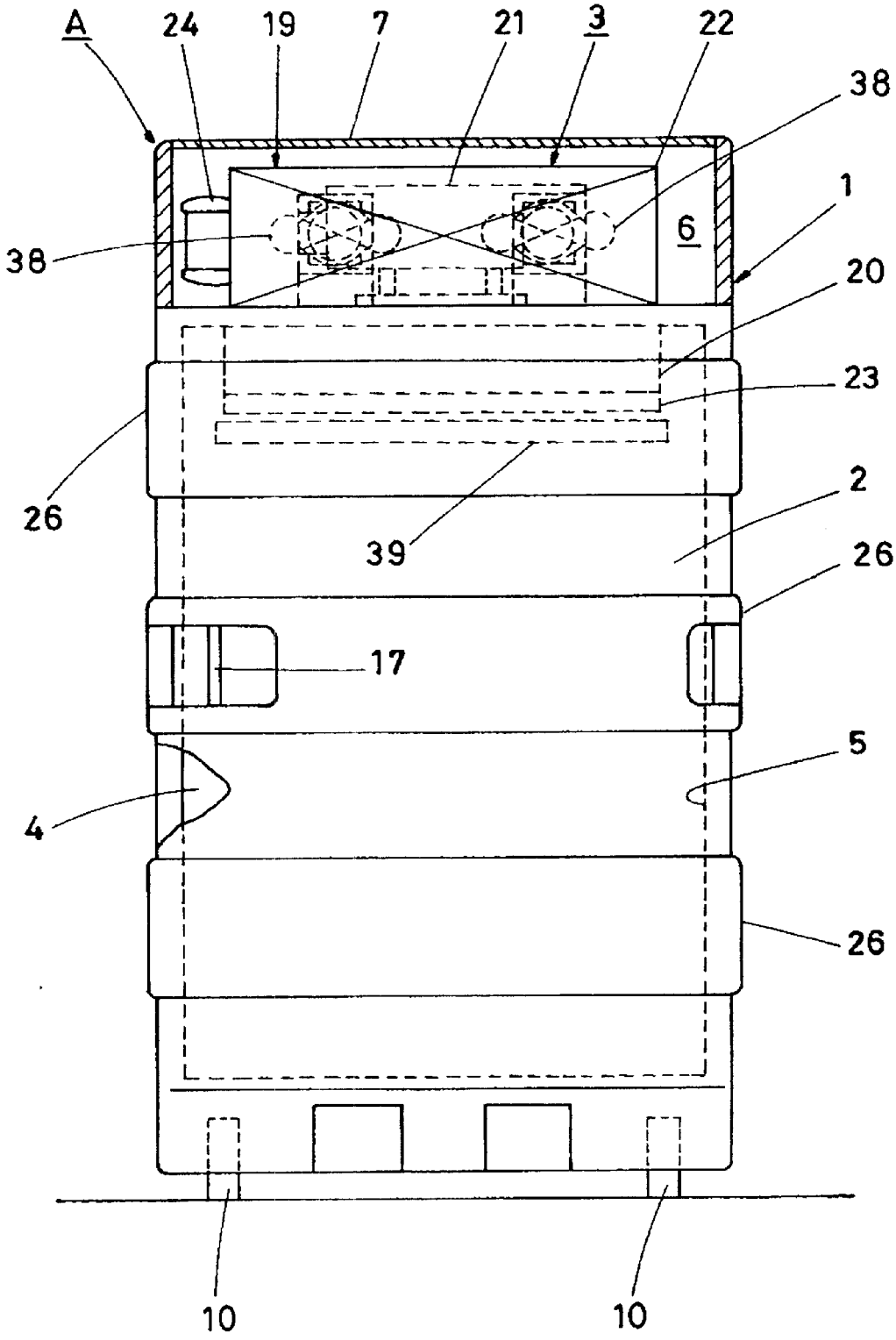
FIG. 2 is a front view of the cold-insulation container of the first embodiment of the present invention, with a part thereof shown in cross section.
Figure 3:
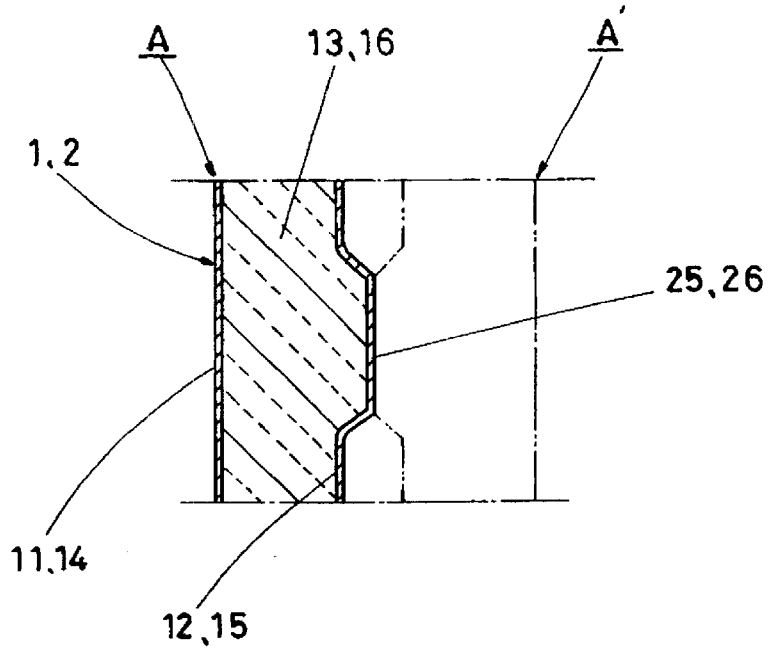
FIG. 3 is an enlarged cross-sectional structural view showing an external wall of a cold-insulation container main body and a door in the cold-insulation container of the first embodiment of the present invention.

Referring to FIGS. 1 to 3, there is shown a cold-insulation container according to a first embodiment of the present invention.

The cold-insulation container of the first embodiment is loaded on a vehicle such as a truck and transported. As shown in FIGS. 1 and 2, the cold-insulation container is comprised of a cold-insulation container main body 1 of heat-insulation structure, a door 2 for opening and closing an opening portion 4 of the cold-insulation container main body 1, and a cold-keeping means 3 disposed in the cold-insulation container main body 1.

The cold-insulation container main body 1 has, at its front side, the opening portion 4 through which products to be cooled are got in and out and is formed into a box-like shape of an oblong rectangular solid. The cold-insulation container main body 1 includes a cold-insulation chamber 5 for accommodating therein products to be cooled and a machine chamber 6 zone-formed above a top plate 5*a* of the cold-insulation chamber 5 and covered with a lid cover 7.

Further, formed in the lid cover 7 are an air drawing opening 8 through which air is fed to the machine chamber 6 and an air blowing-out opening 9 through which air is blown out from the machine chamber 6. Mounted at portions of the bottom of the cold-insulation container main body 1 are casters 10 for moving the cold-insulation container.

An external wall of the cold-insulation chamber 5 in the cold-insulation container main body 1 is comprised of the top plate 5*a*, both lateral plates 5*b* and 5*b*, a rear plate 5*c*, and a bottom plate 5*d*. The external wall of the cold-insulation chamber 5 is constructed by filling a heat-insulation material 13 between an internal plate 11 and an external plate 12, wherein the internal and external plates 11 and 12 are formed of synthetic resin. Further, an external wall of the machine chamber 6 is formed from a single plate which is formed of synthetic resin.

The door 2 is constructed by filling a heat-insulation material 16 between an internal plate 14 and an external plate 15, wherein the internal and external plates 14 and 15 are formed of synthetic resin. Further, mounted on the cold-insulation container is a handle 17 for opening and closing the door 2. Besides, a locking device 18 for maintaining the door 2 in its closed state is provided in the cold-insulation container.

The cold-keeping means 3 is made up of a refrigerating apparatus 19 and a cold-storage device 20 which is cooled by the refrigerating apparatus 19 and stores cold.

The refrigerating apparatus 19 includes a compressor 21 disposed in the machine chamber 6, a condenser 22 disposed in the machine chamber 6, and an evaporator 23 disposed at an upper portion of the cold-insulation chamber 5. And, the cold-storage device 20 is disposed next to the evaporator 23.

The refrigerating apparatus 19 has an accumulator 24 and a cooling fan 38 for cooling the condenser 22. Moreover, the cold-keeping means 3 has a drain pan 39.

The compressor 21, the condenser 22, the evaporator 23, and the accumulator 24 are sequentially connected together by a refrigerant line not shown. Refrigerant is compressed in the compressor 21, then condensed to a liquid form in the condenser 22, and depressurized by an expansion valve (not shown). Thereafter, the refrigerant is evaporated in the evaporator 23. By a latent heat of vaporization in the evaporator 23, a cold-storage material housed in the cold-storage device 20 is cooled and the cold-storage device 20 stores cold. Further, the refrigerating apparatus 19 is operated only at the storage warehouse of a delivery terminal. In other words, the refrigerating apparatus 19 is not operated during transportation of the cold-insulation container. During the transportation, products to be cooled which are stored in the cold-insulation container are kept cool by cold stored in the cold-storage device 20.

Formed on the external wall of the cold-insulation chamber 5 in the cold-insulation container main body 1 are three reinforcement projecting portions 25, 25, and 25 vertically disposed at different levels. Each reinforcement projecting portion 25 is continuous extending from one of both lateral faces to the other lateral face through a rear face of the cold-insulation chamber 5.

Additionally, formed on the door 2 are reinforcement projecting portions 26, 26, and 26 which continuously extend from their corresponding reinforcement projecting portions 25, 25, and 25, respectively, which are positioned on the side of the cold-insulation container main body 1.

As shown in FIG. 3, the reinforcement projecting portions 25 and 26 are formed by causing the external plates 12 and 15 to project outwardly.

The cold-insulation container constructed in the way described above provides the following action and effects.

The cold-insulation container main body 1 and the door 2 become considerably lighter in weight, thereby making it possible to achieve an increase in loadable weight. This considerably improves transportation efficiency.

Furthermore, because of the formation of the reinforcement projecting portions 25 and 26, it is possible to increase the section modulus of the cold-insulation container main body 1 and the door 2. As a result, it is possible to improve the external wall structural strength of the cold-insulation container.

Further, at cold-insulation container handling time, even when two cold-insulation containers A and A' collide with each other as shown by a chain line of FIG. 3, such collision contact will occur between the reinforcement projecting portions of the cold-insulation container A and the reinforcement projecting portions of the cold-insulation container A'. Accordingly, the degree of strength against collision load of the cold-insulation container is enhanced.

Further, with the present embodiment, it is possible to form the reinforcement projecting portions 25 and 26 by only causing the external plates 12 and 15 to project outwardly. Furthermore, the thickness of the heat-insulation materials 13 and 16 in the reinforcement projecting portions 25 and 26 increases, thereby providing an improvement in heat-insulation efficiency.

Second Embodiment

Figure 4:
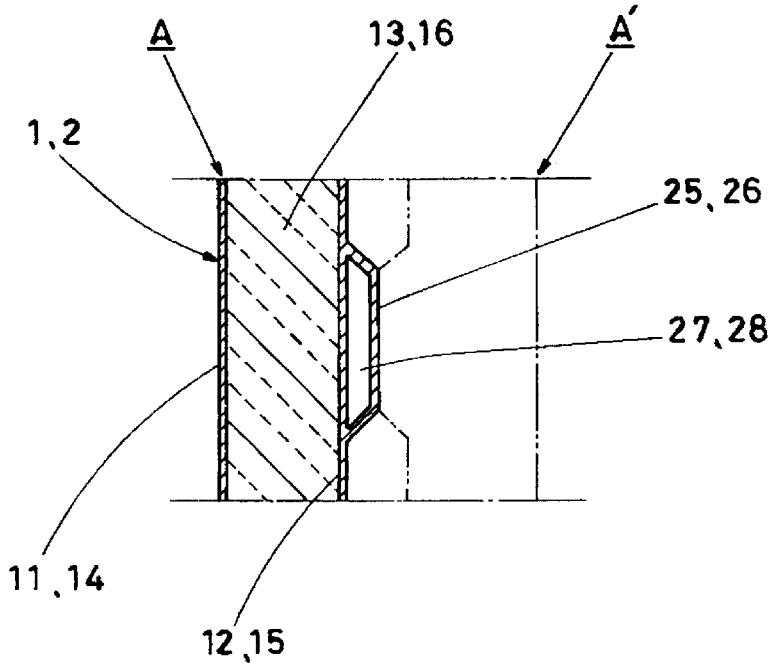
FIG. 4 is an enlarged cross-sectional structural view showing an external wall of a cold-insulation container main body and a door in a cold-insulation container according to a second embodiment of the present invention.

Referring to FIG. 4, there are shown an external-wall structure of a cold-insulation container main body and a door structure in a cold-insulation container according to a second embodiment of the present invention.

The reinforcement projecting portions 25 and 26 of the present embodiment are formed outwardly from and integrally with the external plates 12 and 15, having therein space portions 27 and 28.

In the present embodiment, it is sufficient that the reinforcement projecting portions 25 and 26 are formed outwardly from and integrally with the external plates 12 and 15. Further, by virtue of the space portions 27 and 28 formed in the reinforcement projecting portions 25 and 26, the heat-insulation efficiency at these portions is improved. Other structures, action, and effects of the present embodiment are the same as the first embodiment.

Third Embodiment

Figure 5:
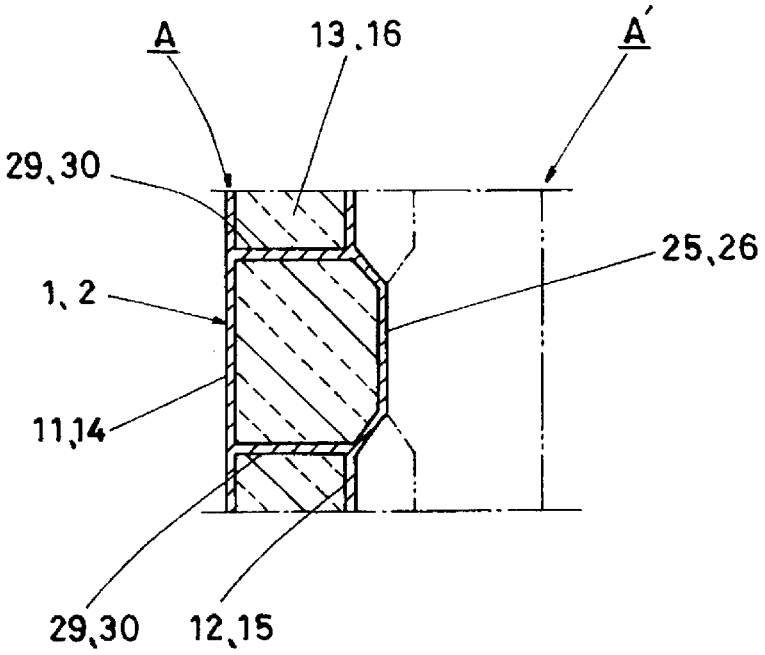
FIG. 5 is an enlarged cross-sectional structural view showing an external wall of a cold-insulation container main body and a door in a cold-insulation container according to a third embodiment of the present invention.

Referring to FIG. 5, there are shown an external-wall structure of a cold-insulation container main body and a door structure in a cold-insulation container according to a third embodiment of the present invention.

The reinforcement projecting portions 25 and 26 of the present embodiment are formed by causing the external plates 12 and 15 to project outwardly. Further, ribs 29 and 30 for connecting the internal plates 11 and 14 to the external plates 12 and 15 are formed integrally with base portions of the reinforcement projecting portions 25 and 26.

In the present embodiment, the internal plates 11 and 14 and the external plates 12 and 15 are reinforced by the ribs 29 and 30 and the strength is improved to a further extent. Other structures, action, and effects of the present embodiment are the same as the first embodiment.

As in the second embodiment, the reinforcement projecting portions 25 and 26 may be formed outwardly from and integrally with the external plates 12 and 15, having therein the space portions 27 and 28. And, the ribs 29 and 30 for connecting the internal plates 11 and 14 to the external plates 12 and 15 may be formed integrally with base portions of the reinforcement projecting portions 25 and 26.

Fourth Embodiment

Figure 6:
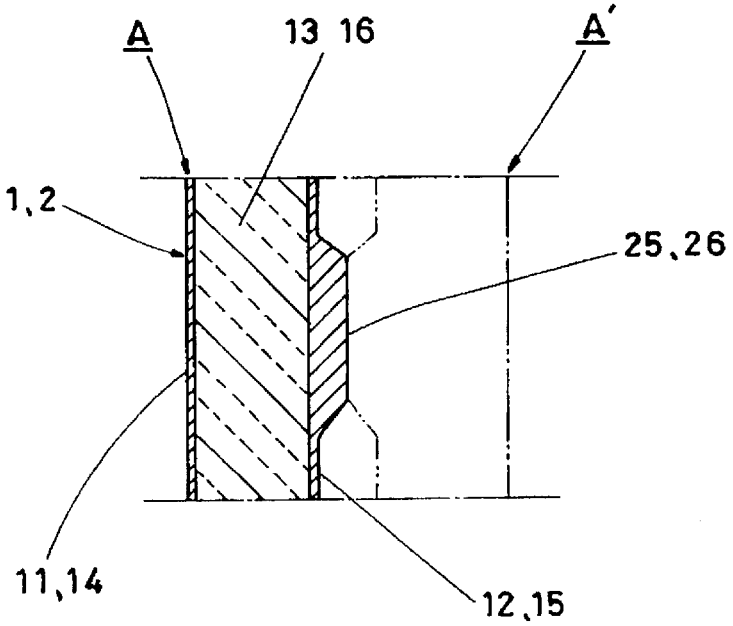
FIG. 6 is an enlarged cross-sectional structural view showing an external wall of a cold-insulation container main body and a door in a cold-insulation container according to a fourth embodiment of the present invention.

Referring to FIG. 6, there are shown an external-wall structure of a cold-insulation container main body and a door structure in a cold-insulation container according to a fourth embodiment of the present invention.

The reinforcement projecting portions 25 and 26 of the present embodiment are formed by increasing the thickness of the external plates 12 and 15.

With the present embodiment, it is possible to form the reinforcement projecting portions 25 and 26 by only increasing the thickness of the external plates 12 and 15. Further, by virtue of such increase in the thickness, the strength of the reinforcement projecting portions 25 and 26 is improved. Other structures, action, and effects of the present embodiment are the same as the first embodiment.

Further, as in the third embodiment, the ribs 29 and 30 for connecting the internal plates 11 and 14 and the external plates 12 and 15 may be formed integrally with base portions of the reinforcement projecting portions 25 and 26.

Fifth Embodiment

Figure 7:
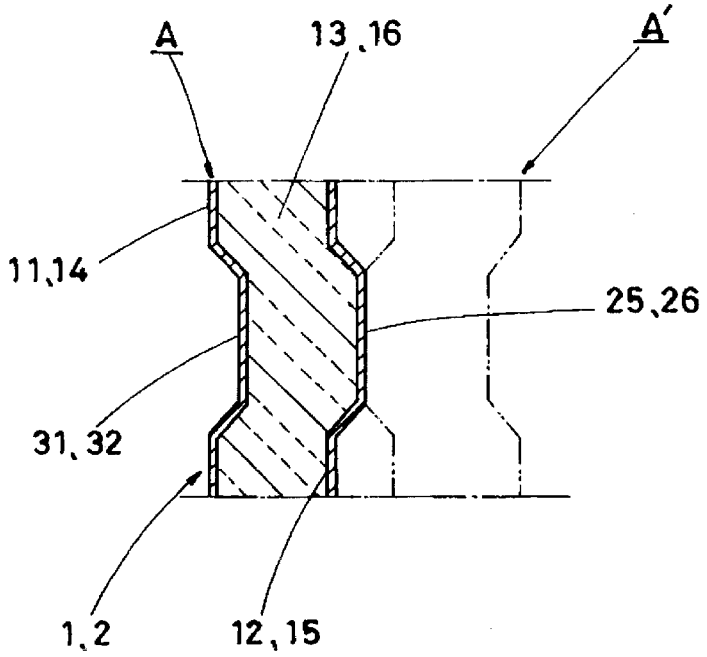
FIG. 7 is an enlarged cross-sectional structural view showing an external wall of a cold-insulation container main body and a door in a cold-insulation container according to a fifth embodiment of the present invention.

Referring to FIG. 7, there is shown an external-wall structure of a cold-insulation container main body and a door structure in a cold-insulation container according to a fifth embodiment of the present invention.

Formed at portions of the internal plates 11 and 14 of the present embodiment corresponding to the reinforcement projecting portions 25 and 26 are outwardly-facing projecting portions 31 and 32 corresponding to the reinforcement projecting portions 25 and 26.

In accordance with the present embodiment, the section modulus of the internal plates 11 and 14 is also increased, thereby improving the degree of strength of the internal plates 11 and 14. And besides, the internal capacity of the cold-insulation container main body 1 also increases. Other structures, action, and effects of the present embodiment are the same as the first embodiment.

Further, as in the third embodiment, the ribs 29 and 30 for connecting the internal plates 11 and 14 to the external plates 12 and 15 may be formed integrally with base portions of the reinforcement projecting portions 25 and 26.

Sixth Embodiment

Figure 8:
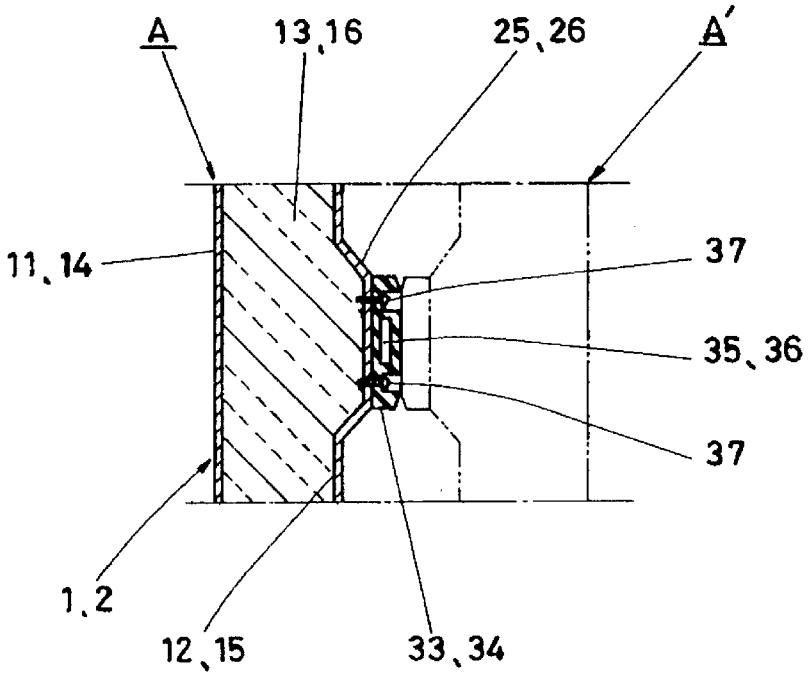
FIG. 8 is an enlarged cross-sectional structural view showing an external wall of a cold-insulation container main body and a door in a cold-insulation container according to a sixth embodiment of the present invention.

Referring to FIG. 8, there is shown an external wall structure of a cold-insulation container main body and a door structure in a cold-insulation container according to a sixth embodiment of the present invention.

Attached by screws 37 to outer surfaces of the reinforcement projecting portions 25 and 26 of the present embodiment are elastic members 33 and 34 formed of rubber or the like. Defined in the elastic members 33 and 34 are hollow portions 35 and 36.

In accordance with the present embodiment, at cold-insulation container handling, even when cold-insulation containers A and A' collide with each other, the elastic members 33 and 34 absorb a collision load. This makes it possible to further reduce the weight of the cold-insulation container main body 1 and the door 2. Other structures, action, and effects of the present embodiment are the same as the first embodiment.

Further, as in the third embodiment, the ribs 29 and 30 for connecting the internal plates 11 and 14 to the external plates 12 and 15 may be formed integrally with base portions of the reinforcement projecting portions 25 and 26.

Further, the elastic members 33 and 34 may be attached to the outer surfaces of the reinforcement projecting portions 25 and 26 of the first to fifth embodiment, as in the present embodiment.

Seventh Embodiment

Figure 9:
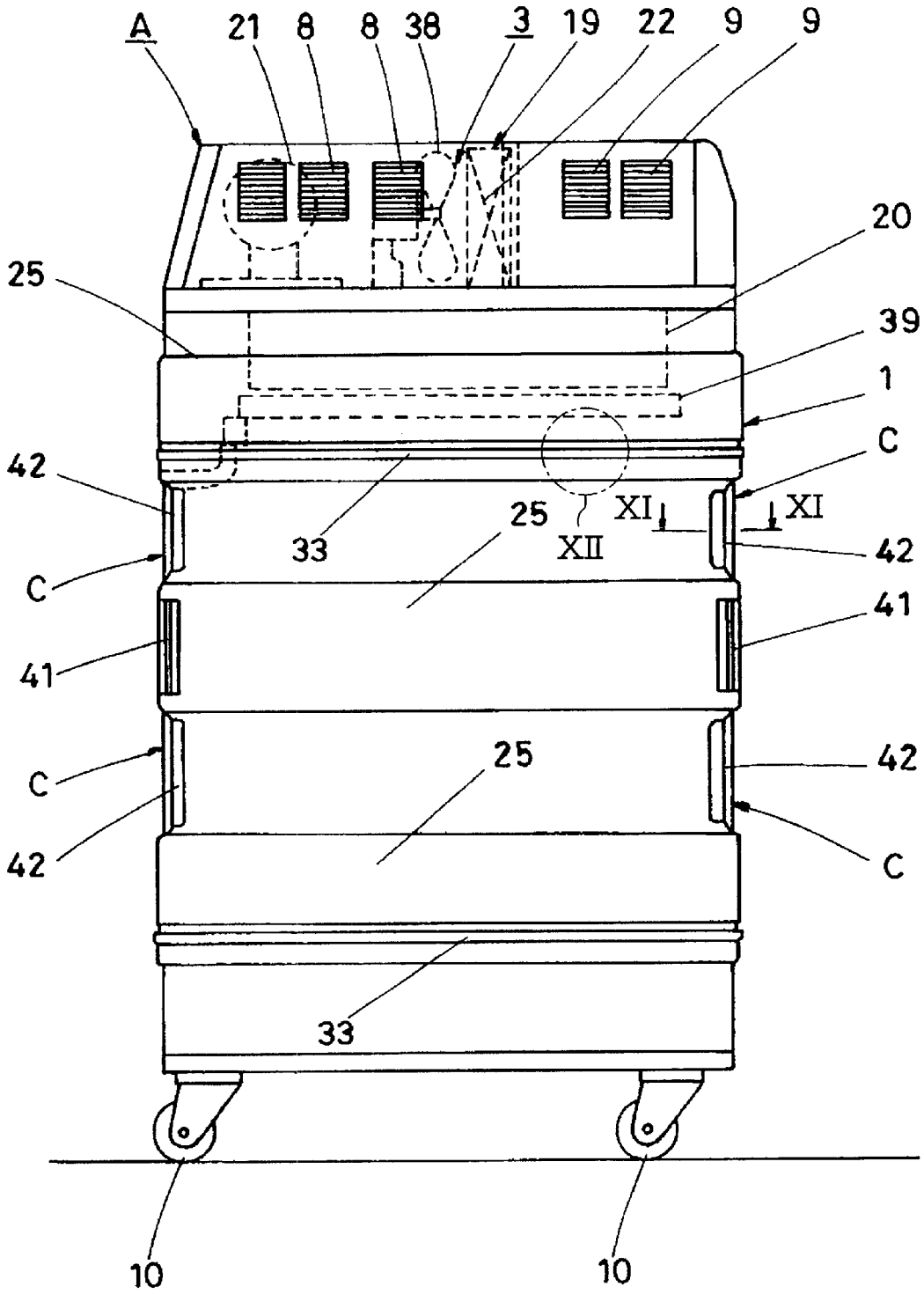
FIG. 9 is a side view of a cold-insulation container according to a seventh embodiment of the present invention.
Figure 10:
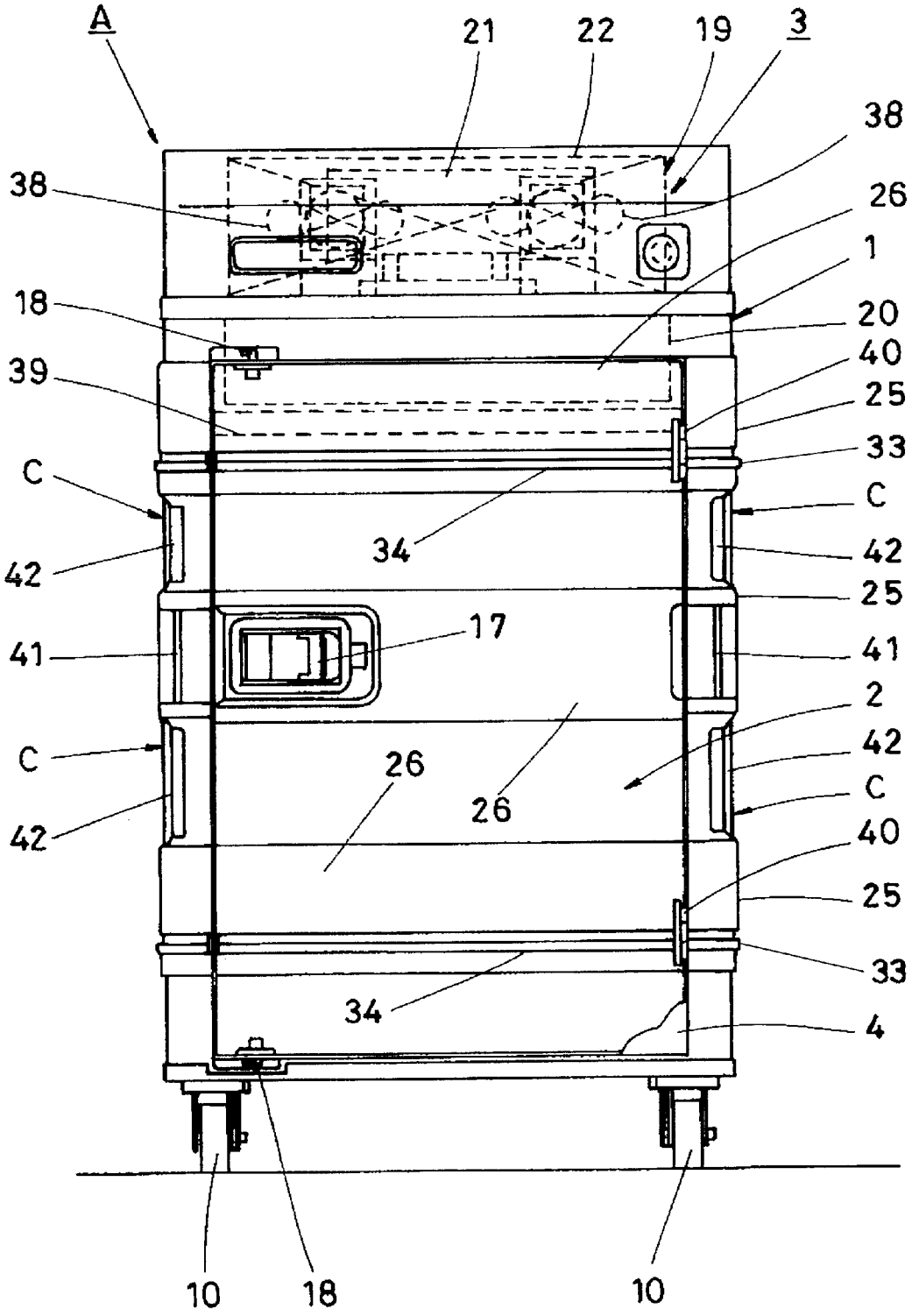
FIG. 10 is a front view of the cold-insulation container of the seventh embodiment of the present invention.
Figure 11:
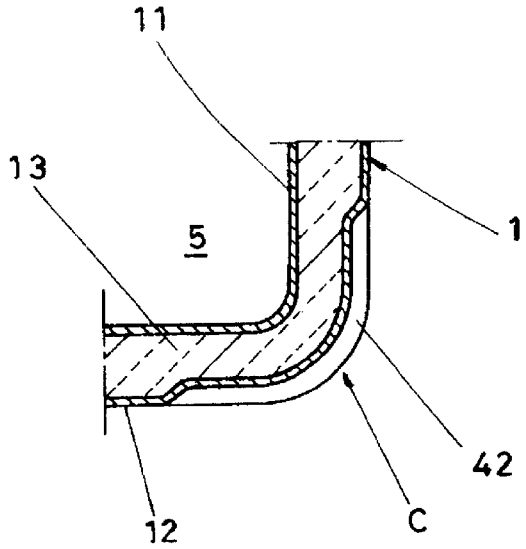
FIG. 11 is an enlarged cross-sectional view taken along XI–XI of FIG. 9.

Referring to FIGS. 9 to 11, there is shown a cold-insulation container according to a seventh embodiment of the present invention.

The door 2 of the present embodiment is fitted, in its closed state, in the opening portion 4 of the cold-insulation container main body 1. The door 2 is supported rotatably by hinges 40 and 40 at a right-hand side edge of the opening portion 4 so that it is opened and closed in a free manner.

Further, the locking device 18 is provided extending from the upper to the lower edge of the opening portion 4 as well as from the upper to lower end of the door 2.

Further, of the reinforcement projecting portions 25, 25, and 25 in the cold-insulation container main body 1, the middle one is provided with handles 41 (which are held when moving a cold-insulation container) at corner portions in areas which are edge portions of the opening portion 4 and at corner portions in areas which are both sides of the rear face of the cold-insulation container main body 1, respectively.

Further, attached by adhesion to the external wall of the cold-insulation container main body 1 and the door 2 of the present embodiment are the elastic members 33 and 34. The elastic members 33 and 34 are located next to lower sides of the upper- and lower-side reinforcement projecting portions 25 and 26. Furthermore, the elastic members 33 and 34 project outwardly beyond the reinforcement projecting portions 25 and 26. The structure of the elastic members 33 and 34 is the same as that of the ones shown in the sixth embodiment.

Further, the elastic members 33 and 34 are not necessarily located next to the reinforcement projecting portions 25 and 26. That is, the elastic member 33 and 34 may be provided at any adequate location of a portion located between the reinforcement projecting portions 25 and 26 and the reinforcement projecting portions 25 and 26. More specifically, the elastic members 33 and 34 may be provided at any adequate location of a portion in the cold-insulation container main body 1 and the door 2 where the reinforcement projecting portions 25 and 26 are not formed.

Further, in the present embodiment, the elastic members 33 and 34 are attached, by adhesion, to the external wall of the cold-insulation container main body 1 and the door 2 in such a way that they are located next to the undersides of the upper- and lower-side reinforcement projecting portions 25 and 26, projecting outwardly beyond the reinforcement projecting portions 25 and 26. The structure of the elastic members 33 and 34 is the same as that of the ones shown in the sixth embodiment. Further, the elastic members 33 and 34 are not necessarily located next to the reinforcement projecting portions 25 and 26; alternatively, they may be positioned at upper or lower portions of the reinforcement projecting portions 25 and 26 (i.e., portions where the reinforcement projecting portions 25 and 26 are not formed in the external wall of the cold-insulation container main body 1 and the door 2).

Apart from the above, typically, this type of cold-insulation container is loaded in the bed of a truck and transported. Accordingly, in order to secure an amount of load that is transported at a time, there is the constraint that such a cold-insulation container is limited in its outer dimensions.

On the other hand, in accordance with the present embodiment, the external wall of the cold-insulation container main body 1 is constructed by filling the heat-insulation material 13 between the synthetic-resin internal and external plates 11 and 12. In this case, it is required that the thickness of the external wall of the cold-insulation container main body 1 be increased in order to secure a specified heat-insulation efficiency as well as a specified degree of strength. Further, it is also necessary to insure that the capacity of the cold-insulation chamber 5 in the cold-insulation container main body 1 is the same as that of conventional ones.

Then, because of the above-stated constraint, the amount of projection of the reinforcement projecting portion 25 must be reduced by an increase in thickness of the external wall of the cold-insulation container main body 1.

To cope with the above, in accordance with the present embodiment, while reducing the amount of projection of the reinforcement projecting portion 25, a recessed portion 42 is formed (see FIG. 1). The recessed portion 42 is formed at a corner portion C of portions sandwiching therebetween the middle reinforcement projecting portion 25 in said cold-insulation container main body 1 where the handle 41 is positioned. The recessed portion 42 extends astride both lateral walls from the corner portion C.

The recessed portion 42 is so formed as to have a size large enough to receive therein fingers of a handler and a depth deep enough not to cause the fingers to project outwardly beyond the reinforcement projecting portion 25. As a result of such arrangement, when moving a cold-insulation container, it is possible to prevent fingers of a handler from being caught between the cold-insulation container and its neighboring one by pushing the cold-insulation container with the fingers placed in the recessed portion 42. This improves the safety during cold-insulation container movement. In addition, there is no need to make the entire portion other than the reinforcement projecting portion 25 in the external wall of the cold-insulation container main body 1 thin, therefore securing heat-insulation efficiency.

Further, in the present embodiment, the recessed portion 42 is formed at the corner portion C of the portions sandwiching therebetween the middle reinforcement projecting portion 25 where the handle 41 is positioned. As a behavior of human beings, it is likely that, when a container handler handles a cold-insulation container, the container handler likely places his fingers on the corner portion C near the handle C. Also at that time, however, the fingers are placed in the recessed portion 42. As a result, the fingers will not be caught between the cold-insulation container that is being handled and its neighboring one.

Further, the recessed portion 42 is not necessarily formed at the corner portion C of the portions sandwiching therebetween the middle reinforcement projecting portion 25. That is, the recessed portion 42 can be formed at any position in which a container handler is able to easily place his fingers. Other structures, action, and effects of the present embodiment are the same as the first embodiment.

Eighth Embodiment

Figure 12:
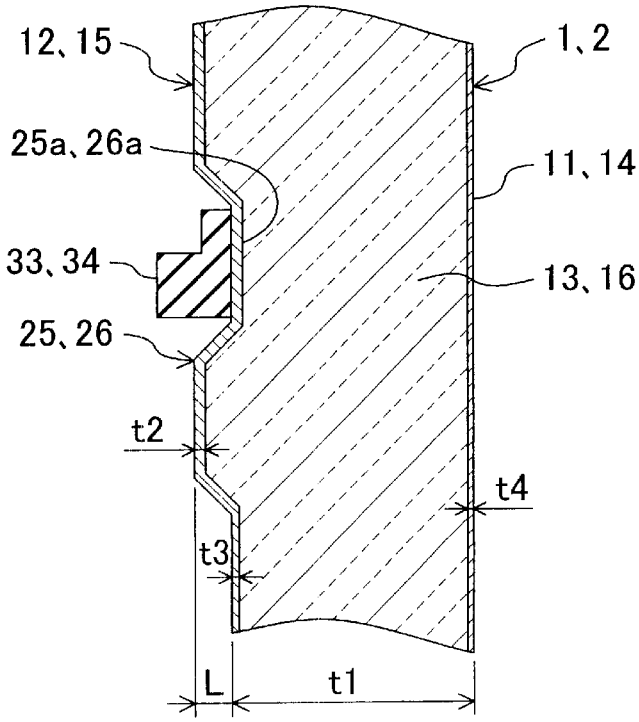
FIG. 12 is an enlarged cross-sectional view of XII of FIG. 9.

Referring to FIG. 12, there are shown an external wall structure of a cold-insulation container main body 1 and a door's 2 structure in a cold-insulation container according to an eighth embodiment of the present invention.

In the present embodiment, the thickness of, for example, the external wall of the cold-insulation container main body 1 in the cold-insulation container of the second embodiment is concretely specified. Accordingly, the cold-insulation container of the present embodiment is identical in basic structure with the cold-insulation container of the second embodiment.

First of all, the thickness (t1) of the external wall of the cold-insulation container main body 1 and the door 2 is 50 mm. In other words, in the external wall of the cold-insulation chamber 5 of the cold-insulation container main body 1, particularly in the front/rear and left/right lateral faces, the thickness t1 defined between the internal plate 11 and the external plate 12 other than the reinforcement projecting portion 25 is set to a value of 50 mm. Further, in the door 2, the thickness t1 between the internal plate 14 and the external plate 15 other than the reinforcement projecting portion 25 is 50 mm.

Further, the thicknesses (t2, t3) of the external plate 12 of the external wall of the cold-insulation container main body 1 and the external plate 15 of the door 2 are greater than the thickness (t4) of the internal plate 11 of the external wall of the cold-insulation container main body 1 and the internal plate 14 of the door 2.

Moreover, in the external plate 12 of the cold-insulation container main body 1 and in the external plate 15 of the door 2, the thickness t2 of the reinforcement projecting portions 25 and 26 is greater than the thickness t3 of portions other than the reinforcement projecting portions 25 and 26.

More specifically, the thickness t4 of the internal plate 11 of the external wall of the cold-insulation container main body 1 and the internal plate 14 of the second door 2 is, for example, 0.8 mm. On the other hand, in the external plate 12 of the external wall of the cold-insulation container main body 1 and in the external plate 15 of the door 2, the thickness t2 of the reinforcement projecting portions 25 and 26 is, for example, 1.5 mm and the thickness t3 of portions other than the reinforcement projecting portions 25 and 26 is, for example, 1.1 mm.

Further, the amount (L) of projection of the reinforcement projecting portions 25 and 26 is set such that the reinforcement projecting portions 25 and 26 project 5 mm or more beyond the portions other than the reinforcement projecting portions 25 and 26.

Furthermore, in the external plates 12 and 15 of the portion corresponding to the cold-insulation chamber 5, the reinforcement projecting portions 25 and 26 are formed such that the occupation ratio of the reinforcement projecting portions 25 and 26 is greater than that of the other portions. That is, in the four lateral faces of the cold-insulation container main body 1 except for the machine chamber 6, the occupation ratio of the reinforcement projecting portions 25 and 26 is equal to or greater than that of the other recessed portions.

On the other hand, the elastic member 33 and 34 are formed, in cross section, into an L-shape. And, formed in the reinforcement projecting portion 25 of the external wall of the cold-insulation container main body 1 and in the reinforcement projecting portion 26 of the door 2 are attachment grooves 25*a* and 26*a* for the elastic members 33 and 34.

The attachment grooves 25*a* and 26*a* are formed by inwardly denting the external plate 12 of the cold-insulation container main body 1 and the external plate 15 of the door 2. And, the attachment grooves 25*a* and 26*a* correspond to the bottom width of the elastic members 33 and 34, wherein the bottom of the elastic members 33 and 34 are attached by adhesive to the attachment grooves 25*a* and 26*a*.

Accordingly, in the present embodiment, the thickness of the external plate 12 of the cold-insulation container main body 1 and the external plate 15 of the door 2 is made greater than the thickness of the internal plate 11 of the cold-insulation container main body 1 and the internal plate 14 of the door 2, so that it is possible to make the insuring of weight reduction and the insuring of strength compatible. That is, the strength is secured by increasing the thickness of the external plates 12 and 15 to which great force such as collision load is applied and the reduction in weight is achieved by reducing the thickness of the internal plates 11 and 14.

Furthermore, the thickness of the reinforcement projecting portions 25 and 26 of the external plates 12 and 15 is made greater than that of the other portions, so that it is possible to maintain a certain degree of strength sufficient enough to withstand collision load et cetera.

Moreover, the reinforcement projecting portions 25 and 26 project 5 mm or more, therefore insuring a sufficient degree of strength against collision et cetera.

Further, in the external plates 12 and 15 of the portion corresponding to the cold-insulation chamber 5, the occupation ratio of the reinforcement projecting portions 25 and 26 is made equal to or greater than that of the other portions, so that a specified degree of strength is insured positively.

Furthermore, the attachment grooves 25*a* and 26*a* for the elastic members 33 and 34 are formed in the external plates 12 and 15. This increases the section modulus of the external plates 12 and 15, thereby improving the strength to a further extent.

Moreover, the elastic members 33 and 34 are attached into the attachment grooves 25*a* and 26*a*, thereby making it possible to perform accurate positioning of the elastic members 33 and 34.

Other structure, action, and effects of the present embodiment are the same as the seventh embodiment. Further, the structure of the external plates 12 and 15 and the structure of the internal plates 11 and 14 (e.g., their thicknesses) may be applied to the cold-insulation container of the first embodiment.

Other Embodiment

The description of each of the foregoing embodiments has been made in terms of cold-insulation containers which are equipped with a refrigerating apparatus. However, the present invention is applicable to cold-insulation containers without a refrigerating apparatus. That is, the present invention is applicable to a cold-insulation container using only a cold-storage material.

Industrial Applicability

As described above, the cold-insulation containers of the present invention are useful when loaded on a truck for transportation. Particularly, the cold-insulation containers of the present invention are suitable for securing a specified amount of load when loaded in a truck bed.

What is claimed is:

1. A cold insulation container comprising a cold-insulation container main body (1) which is a heat-insulation structure, a door (2) for opening and closing an opening portion (4) of said cold-insulation container main body (1), and cold-keeping means (3) which is disposed in said cold-insulation container main body (1), wherein said cold-keeping means (3) includes a refrigerating apparatus (19) which is positioned in said cold-insulation container main body (1) and a cold-storage device (20) which is cooled by said refrigerating apparatus (19) and stores cold;

wherein an external wall of said cold-insulation container main body (1) and said door (2) are formed from a synthetic resin material; and wherein outwardly projecting portions (25, 26) for reinforcement are formed on said external wall of said cold-insulation container main body (1) and on said door (2), respectively.

2. A cold-insulation container comprising a cold-insulation container main body (1) which is a heat-insulation structure, a door (2) for opening and closing an opening portion (4) of said cold-insulation container main body (1), and cold-keeping means (3) which is disposed in said cold-insulation container main body (1), wherein an external wall of said cold-insulation container main body (1) and said door (2) are formed from a synthetic resin material; and wherein outwardly projecting portions (25, 26) for reinforcement are formed on said external wall of said cold-insulation container main body (1) and on said door, (2), respectively.

3. The cold-insulation container of claim 1 or claim 2, wherein said external wall of said cold-insulation container main body (1) and said door (2) are constructed by filling a heat-insulation material (13) between a synthetic-resin internal plate (11) and a synthetic-resin external plate (12), and by filling a heat-insulation material (16) between a synthetic-resin internal plate (14) and a synthetic-resin external plate (15); and wherein said reinforcement projecting portions (25, 26) are formed by causing said external plates (12, 15) to project outwardly.

4. The cold-insulation container of claim 3, wherein ribs (29,30) for connecting said internal plates (11, 14) to said external plates (12, 15) are formed at base portions of said reinforcement projecting portions (25, 26).

5. The cold-insulation container of claim 3, wherein outwardly-facing projecting portions (31, 32) corresponding to said reinforcement projecting portions (25, 26) are formed at portions of said internal plates (11, 14) corresponding to said reinforcement projecting portions (25, 26).

6. The cold-insulation container of claim 3, wherein the thickness of said reinforcement projecting portion (25) of said external plate (12) in said external wall of said cold-insulation container main body (1) is greater than that of portions of said external plate (12) other than said reinforcement projecting portion (25).

7. The cold-insulation container of claim 3, wherein said reinforcement projecting portion (25) of said external plate (12) in said external wall of said cold-insulation container main body (1) projects 5 mm or more.

8. The cold-insulation container of claim 1 or claim 2, wherein said external wall of said cold-insulation container main body (1) and said door (2) are constructed by filling a heat-insulation material (13) between a synthetic-resin internal plate (11) and a synthetic-resin external plate (12), and by filling a heat-insulation material (16) between a synthetic-resin internal plate (14) and a synthetic-resin external plate (15); and wherein said reinforcement projecting portions (25, 26) are formed outwardly from and integrally with said external plates (12, 15), having therein space portions (27, 28).

9. The cold-insulation container of claim 8, wherein ribs (29, 30) for connecting said internal plates (11, 14) to said external plates (12, 15) are formed at base portions of said reinforcement projecting portions (25, 26).

10. The cold-insulation container of claim 8, wherein outwardly-facing projecting portions (31, 32) corresponding to said reinforcement projecting portions (25, 26) are formed at portions of said internal plates (11, 14) corresponding to said reinforcement projecting portions (25, 26).

11. The cold-insulation container of claim 1 or claim 2, wherein said external wall of said cold-insulation container main body (1) and said door (2) are constructed by filling a heat-insulation material (13) between a synthetic-resin internal plate (11) and a synthetic-resin external plate (12), and by filling a heat-insulation material (16) between a synthetic-resin internal plate (14) and a synthetic-resin external plate (15); and wherein said reinforcement projecting portions (25, 26) are formed by increasing the thickness of said external plates (12, 15).

12. The cold-insulation container of claim 11, wherein ribs (29,30) for connecting said internal plates (11, 14) to said external plates (12, 15) are formed at base portions of said reinforcement projecting portions (25, 26).

13. The cold-insulation container of claim 11, wherein outwardly-facing projecting portions (31, 32) corresponding to said reinforcement projecting portions (25, 26) are formed at portions of said internal plates (11, 14) corresponding to said reinforcement projecting portions (25, 26).

14. The cold-insulation container of claim 1 or claim 2, wherein elastic members (33, 34) are attached to outer surfaces of said reinforcement projecting portions (25, 26).

15. The cold-insulation container of claim 14, wherein hollow portions (35, 36) are defined in said elastic members (33, 34).

16. The cold-insulation container of claim 14, wherein attachment grooves (25*a*, 26*a*) for said elastic members (33, 34) are formed in said reinforcement projecting portions (25, 26) in said external wall of said cold-insulation container main body (1) and said door 2; and wherein said elastic members (33, 34) are attached into said attachment grooves (25*a*, 26*a*).

17. The cold-insulation container of claim 1 or claim 2, wherein elastic members (33, 34) are attached to said external wall of said cold-insulation container main body (1) and the door (2) so that said elastic members (33, 34) project outwardly beyond said reinforcement projecting portions (25, 26).

18. The cold-insulation container of claim 17, wherein hollow portions (35, 36) are defined in said elastic members (33, 34).

19. The cold-insulation container of claim 1 or claim 2, wherein a recessed portion (42) is formed at a corner portion (C) of portions sandwiching therebetween said reinforcement projecting portion (25) in said cold-insulation container main body (1), said recessed portion (42) extending astride both lateral walls from said corner portion (C).

20. The cold-insulation container of claim 19, wherein a handle (41) that is held when handling said cold-insulation container is positioned in said reinforcement projecting portion 25 sandwiched between said recessed portions (42).

21. The cold-insulation container of claim 1 or claim 2, wherein said external wall of said cold-insulation container main body (1) and said door (2) are constructed by filling a heat-insulation material (13) between a synthetic-resin internal plate (11) and a synthetic-resin external plate (12), and by filling a heat-insulation material (16) between a synthetic-resin internal plate (14) and a synthetic-resin external plate (15); and wherein the thickness of said external plates (12, 15) of said cold-insulation container main body (1) and the door (2) is greater than that of said internal plates (11, 14) of said cold-insulation container main body (1) and the door (2).

22. The cold-insulation container of claim 1 or claim 2, wherein the occupation ratio of said reinforcement projecting portions (25, 26) of said external wall of said cold-insulation container main body (1) and said door (2). is equal to or greater than that of portions other than said reinforcement projecting portion (25) of said external wall and said door (2).

* * * * *